US006983845B2

(12) United States Patent
Shah et al.

(10) Patent No.: US 6,983,845 B2
(45) Date of Patent: Jan. 10, 2006

(54) RECLOSEABLE STORAGE BAG WITH USER-DEFORMABLE AIR VENT

(75) Inventors: Ketan N. Shah, Gurnee, IL (US); Peggy B. Winiarski, Franksville, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 540 days.

(21) Appl. No.: 10/185,299

(22) Filed: Jun. 28, 2002

(65) Prior Publication Data

US 2004/0000502 A1 Jan. 1, 2004

(51) Int. Cl.
*B65D 33/01* (2006.01)

(52) U.S. Cl. ..... 206/524.8; 383/103

(58) Field of Classification Search ..... 206/524.8; 383/3, 103, 59, 66, 100, 102
See application file for complete search history.

(56) References Cited

U.S. PATENT DOCUMENTS

| | | | | |
|---|---|---|---|---|
| 4,310,118 | A | | 1/1982 | Kisida et al. |
| 5,240,112 | A | | 8/1993 | Newburger |
| 5,407,087 | A | | 4/1995 | Giblin et al. |
| 5,450,963 | A | | 9/1995 | Carson |
| 5,480,030 | A | * | 1/1996 | Sweeney et al. ..... 206/524.8 |
| 5,492,241 | A | | 2/1996 | Barnett et al. |
| 5,523,236 | A | | 6/1996 | Nuzzo |
| 5,584,409 | A | | 12/1996 | Chemberlen |
| 5,692,837 | A | | 12/1997 | Beer |
| 5,829,884 | A | | 11/1998 | Yeager |
| 5,839,582 | A | | 11/1998 | Strong et al. |
| 5,881,881 | A | | 3/1999 | Carrington |
| 5,988,426 | A | | 11/1999 | Stern |
| 5,996,800 | A | | 12/1999 | Pratt |
| 6,039,182 | A | | 3/2000 | Light |
| 6,056,439 | A | | 5/2000 | Graham |
| 6,059,457 | A | | 5/2000 | Sprehe et al. |
| 6,070,397 | A | * | 6/2000 | Bachhuber ..... 53/512 |
| 6,070,728 | A | | 6/2000 | Overby et al. |
| 6,076,967 | A | | 6/2000 | Beaudette |
| 6,132,089 | A | | 10/2000 | Galomb et al. |
| 6,149,304 | A | | 11/2000 | Hamilton et al. |
| 6,194,011 | B1 | * | 2/2001 | Glaser ..... 426/123 |
| 6,231,236 | B1 | | 5/2001 | Tilman |
| 6,274,181 | B1 | | 8/2001 | Richison et al. |
| 6,357,915 | B2 | | 3/2002 | Anderson |
| 6,378,272 | B1 | | 4/2002 | Archibald et al. |
| 6,575,191 | B2 | | 6/2003 | Skeens et al. |
| 6,604,634 | B2 | * | 8/2003 | Su ..... 206/524.8 |
| 6,634,384 | B2 | | 10/2003 | Skeens et al. |
| 6,692,147 | B2 | | 2/2004 | Nelson |
| 2002/0043052 | A1 | | 4/2002 | Gyorffy |
| 2003/0066267 | A1 | | 4/2003 | Nelson |
| 2004/0007494 | A1 | | 1/2004 | Popeil et al. |

FOREIGN PATENT DOCUMENTS

| | | |
|---|---|---|
| DE | 198 43 430 A1 | 3/2000 |
| EP | 0 729 901 A1 | 4/1996 |
| JP | 03212355 | 9/1991 |
| JP | 8198274 | 8/1996 |

OTHER PUBLICATIONS

International Search Report for Application No. PCT/US03/20478; report dated Oct. 1, 2003.
International Search Report for Application No. PCT/US03/20479; report dated Nov. 11, 2003.

* cited by examiner

*Primary Examiner*—Jacob K. Ackun, Jr.

(57) ABSTRACT

A recloseable storage bag is disclosed which may include first and second sides having closed sides and an open top. Primary closure members may be provided proximate the top, with a secondary closure element being provided in one of the sides to enable gas to be evacuated from the bag after the primary closure members are closed. The secondary closure member may be user-deformable, and reclosable after the gas is evacuated.

4 Claims, 3 Drawing Sheets

FIG. 1
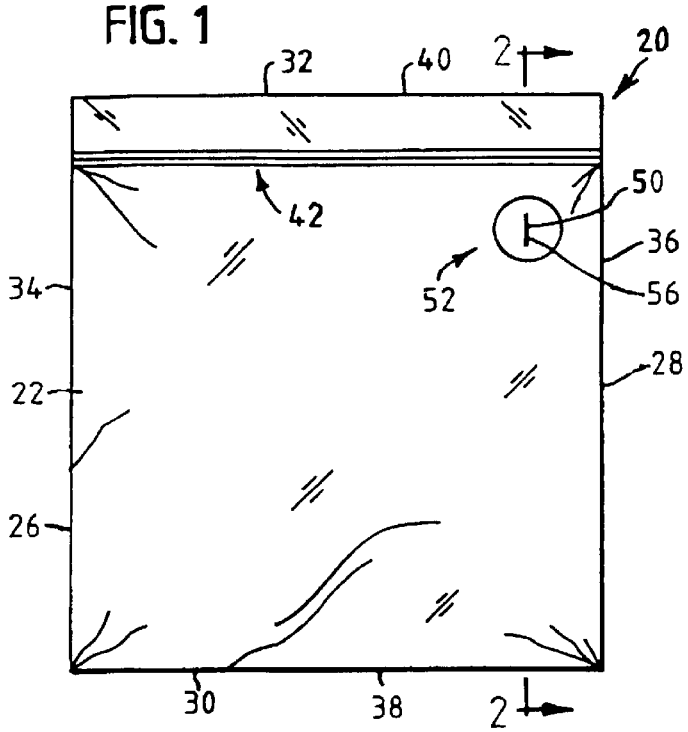
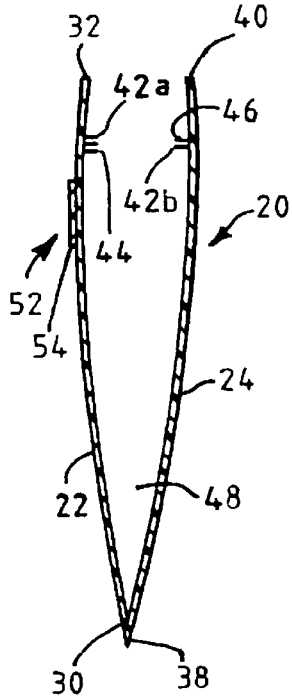
FIG. 2
FIG. 4
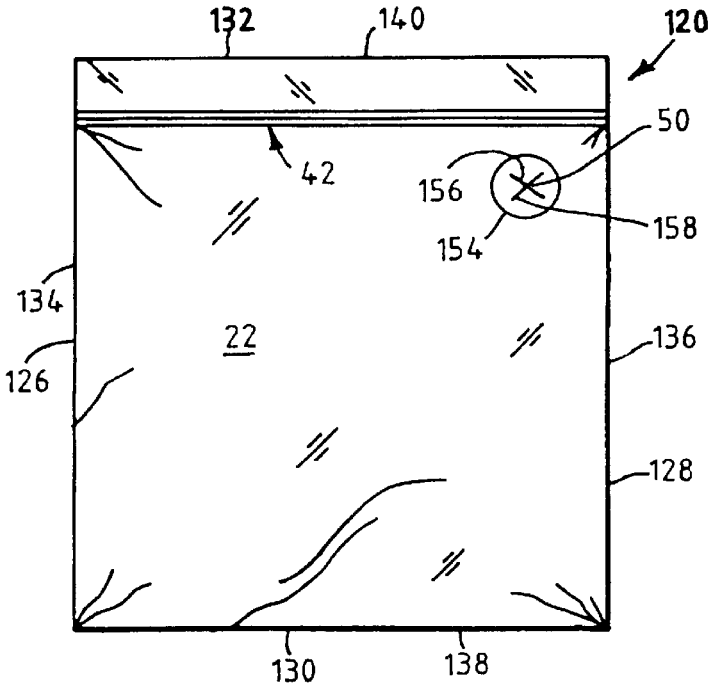
FIG. 3
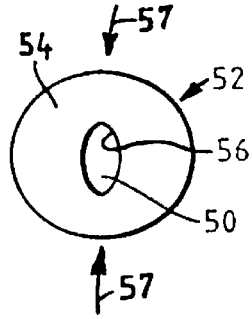

RECLOSEABLE STORAGE BAG WITH USER-DEFORMABLE AIR VENT

FIELD OF THE DISCLOSURE

The disclosure generally relates to bags and, more particularly, to recloseable food storage bags.

BACKGROUND OF THE DISCLOSURE

Reclosable storage bags are well known, especially with regard to food storage. Such bags are generally made out of a plastic film and have two side walls which are sealed around the edges. Such material is fluid impermeable, relatively inexpensive, and can be manufactured in transparent form thereby facilitating content identification. Accordingly, plastic bags have become the dominant product of choice in the area of food storage bags.

Such bags are typically recloseable and substantially sealable. One common approach to provide such features employs closure members at a top edge of a bag having first and second thermoplastic layers folded or heat sealed along bottom and first and second side edges. The closure members may be provided in the form of mating male and female profiles such as those provided by the present assignee under the ZIPLOC® trademark. The male and female profiles are also typically manufactured from plastic, with the male profile including a linear tab adapted to be interlocked with a linear groove of the female profile.

The male and female profiles can be connected to close the bag by pinching and pulling across the closure members along the length of the top edges. Such motion can be accomplished with the thumb and forefinger of a user, or through the use of a sliding element mounted to the male and female profiles, as is the case with bags provided by the present assignee under the ZIPLOC® trademark as well.

While such bags have been met with extraordinary commercial success from their inception until the present day, the assignee continues to improve its product offerings. One area which the assignee has identified as grounds for improvement involves the ability to evacuate gas from a bag after sealing. While the primary closure found at the top of many plastic bags provides an airtight seal, air remaining enclosed in the bag after closure enables bacterial growth and therefore hinders the preservation and freshness the bags are intended to maintain.

It would therefore be an advance in the art of bags to provide a bag with an evacuation aperture provided with a secondary closure, or valve, for sealing the aperture. In this manner, a bag may be closed at the top using the primary closure member, as described above, and subsequently evacuated of gas and resealed using the aperture and secondary closure, respectively.

SUMMARY OF THE DISCLOSURE

In accordance with one aspect of the disclosure, a recloseable storage bag is disclosed which may include first and second sides attached along bottom, left, and right sides, primary closure members provided proximate top edges, an aperture in one of the sides, and a secondary closure element associated with the aperture. The secondary closure element may be user-deformable.

In accordance with another aspect of the disclosure, a method of evacuating gas from a recloseable storage bag is disclosed which may include providing a bag, closing the bag using primary closure members positioned at a top of the bag, and compressing the bag to force gas through the aperture and secondary closure element. The bag may have first and second sides connected along first and second side edges. The bag may include a top and a bottom with the bottom being closed and the top being adapted to be opened and closed using the primary closure members. The bag may further include an aperture in at least one of the sides, with the secondary closure element being operatively associated with the aperture and being user-deformable.

In accordance with another aspect of the disclosure, a recloseable storage bag is disclosed which may include a first side, a second side, primary closure members, and means for evacuating gas from the bag after the primary closure members are closed, the means for evacuating being user-deformable.

These and other aspects and features of the disclosure will become more apparent upon reading the following detailed description when taken in conjunction with the accompanying drawings.

BRIEF DESCRIPTION OF THE DRAWINGS

FIG. 1 is a front view of bag constructed in accordance with the teachings of the disclosure;

FIG. 2 is sectional view of the bag of FIG. 1 taken along line 2—2 of FIG. 1;

FIG. 3 is a front view of the secondary closure member of FIG. 1, but with the secondary closure element shown in an open position;

FIG. 4 is a front view of first alternative embodiment of a bag constructed in accordance with the teachings of the disclosure;

Figure 5:
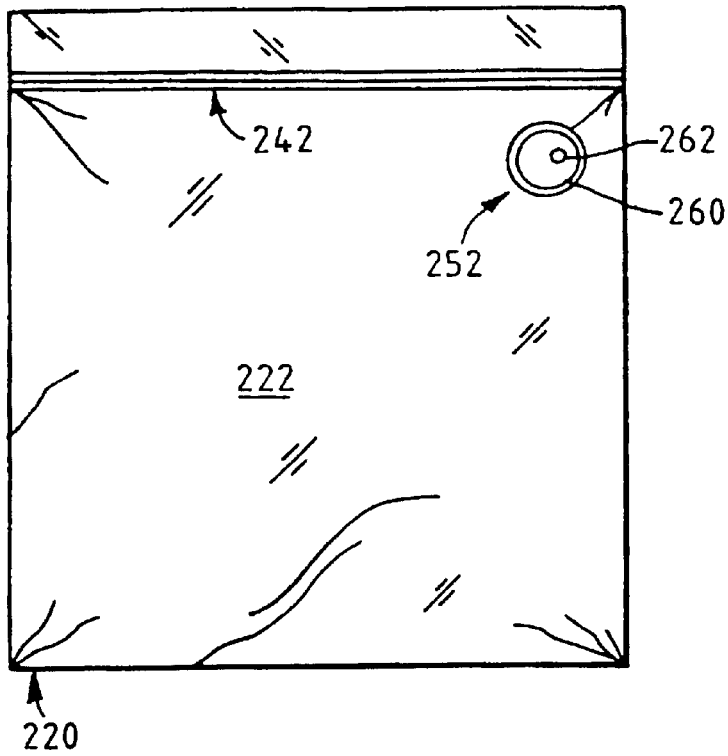
FIG. 5 is a front view of a second alternative embodiment of a bag constructed in accordance with the teachings of the disclosure.

While the disclosure is susceptible to various modifications and alternative embodiments, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE DISCLOSURE

Referring now to the drawings, and with specific reference to FIG. 1, a recloseable storage bag constructed in accordance with the teachings of the disclosure is generally referred to by reference numeral 20. While the bag 20 will be described herein with predominant reference to food storage bags such as those sold by the assignee under its ZIPLOC® trademark, it is to be understood that the teachings of the disclosure could be employed in any other type of bag, such as, but not limited to, bags used to store perishable goods other than food, as well as bags which are not intended to be recloseable.

With reference again to FIG. 1, as well as FIG. 2, the bag 20 is shown to include a first side wall 22 joined to a second side wall 24. More specifically, the first side 22 includes a left edge 26, a right edge 28, a bottom edge 30, and a top edge 32, while the second side 24 includes a left edge 34, a right edge 36, a bottom edge 38, and a top edge 40. The respective left edges 26, 34 are joined together, as are the respective right edges 28, 36, and the respective bottom edges 30, 38. By "joined" together, it is to be understood that the edges can be formed by heat sealing, ultrasonic welding, impulsing welding, or the like, or can be integral and simply separated by a fold. As such bags 20 are typically manufactured from polyethylene or similar plastic material, it has been found to be advantageous to form one edge, e.g., the bottom edge, with a fold, and the other two edges, e.g., the left and right edges, with heat seals.

The top edges 32, 40, however, are not permanently closed, but rather are provided with recloseable primary closure members 42*a*, 42*b*. The primary closure elements are depicted in the form of mating male and female profiles, wherein the male profile 42*a* includes three ribs 44, while the female profile includes two ribs 46. As will be readily understood by one of ordinary skill in the art, the primary closure members 42*a*, 42*b* can be joined using, for example, a pinch-and-seal motion with the thumb and forefinger. Such pressure causes the ribs 44 and 46 to frictionally intermesh in alternating fashion, thereby substantially sealing the bag. A slider or the like can be provided to facilitate such zipper action. In other embodiments, the primary closure members 42*a*, 42*b* need not be provided in such zipper fashion, but could be provided in any other suitable fashion such as, but not limited to, adhesive fasteners, hook and loop fasteners, invertable folds, buttons, clips, and the like.

In so doing, the bag 20 is formed to have an interior storage space 48 accessible between the top edges 32, 40 when the primary closure members 42*a*, 42*b* are open. After the primary closure members 42*a*, 42*b* are closed, the bag 20 is substantially sealed. In order to remove excess gas, such as air, from the interior storage space 48, an aperture 50 may be provided in one or more of the side walls 22, 24. As shown best in FIG. 2, the aperture 50 may be provided in the first side wall 22 to enable gas to exit the storage space 48 as by compressing the bag 20, or otherwise manipulating the bag 20, to force excess air from the space 48 to the atmosphere through the aperture 50.

The bag 20 may further include a secondary closure element 52 adapted to close the aperture 50. In the embodiment of FIGS. 1 and 2, the secondary closure element 52 is provided in the form of a user-deformable layer 54 positioned over the aperture 50 and attached to the side wall 22. The user-deformable layer 54 may include a linear slit 56 and be manufactured from a flexible material. For example, the deformable layer 54 may be manufactured from polyethylene, or a polyethylene compatible polymer such as ethyl acetate, polybutylene, Kraton®, chemically modified polyethylenes (crosslinked polyethylene, chlorinated or fluorinated polyethylene), or blends of polyethylene (such as polyethylene blended with polypropylene). The flexibility of such materials enable the layer 54 to be deformed from the closed position shown in FIG. 1, to the open position shown in FIG. 3, simply by squeezing the layer 54 along the linear axis of the slit 56, as indicated by arrows 57. Upon releasing the layer 54, the flexibility of the material enables layer 54 to revert to its original shape, thereby closing the slit 56.

A variation on the embodiment of FIGS. 1 and 2 is depicted in FIG. 4. As shown therein, the deformable layer 154 includes first and second linear slits 156 and 158, respectively, disposed at transverse angles. With such an embodiment the deformable layer 154 can be squeezed along a longitudinal axis of either slit to enable the slits 156 and 158 to open. At this point it is important to note that with regard to the various embodiments disclosed herein, the numbering system will repeat like reference numerals for like elements employed in the various embodiments, with the exception that each embodiment will have its own, sequential prefix. Accordingly, the embodiment of FIG. 3 will use reference numerals having a one hundred series prefix, and later described embodiments will have a two-hundred series prefix, and so on.

Figure 6:
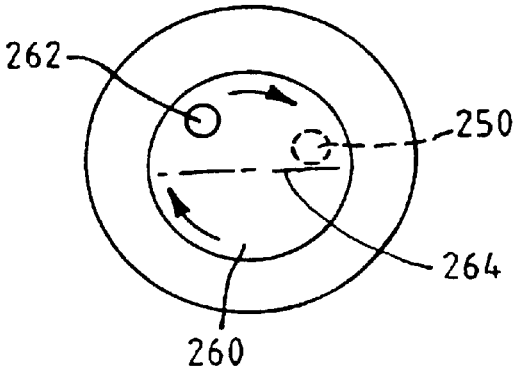
FIG. 6 is an enlarged plan view of the secondary closure element depicted in FIG. 5.
Figure 7:
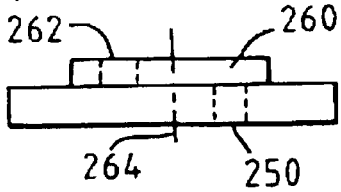
FIG. 7 is a sectional view of the secondary closure element of FIG. 6, taken along line 7—7 of FIG. 6.

In an alternative embodiment, the secondary closure element 252 can be provided in the form of a user-deformable, rotatable wheel 260. As shown in FIGS. 5–7, the wheel 260 may include an opening 262 adapted to be rotated into alignment with an aperture 250 formed in the bag 220. In so doing gas from the interior space 248 is able to exit the bag 220. After compressing the bag 220 and evacuating the gas therein, the wheel 260 can be rotated about a pivot 264 so that the opening 262 is not aligned with the aperture 250. In other similar embodiments, the secondary closure element 252 may be otherwise deformed as by, for example, sliding a perforated lever (not shown) relative to the aperture 250, or threadably twisting a knob (not shown) away from the aperture 250.

Figure 8:
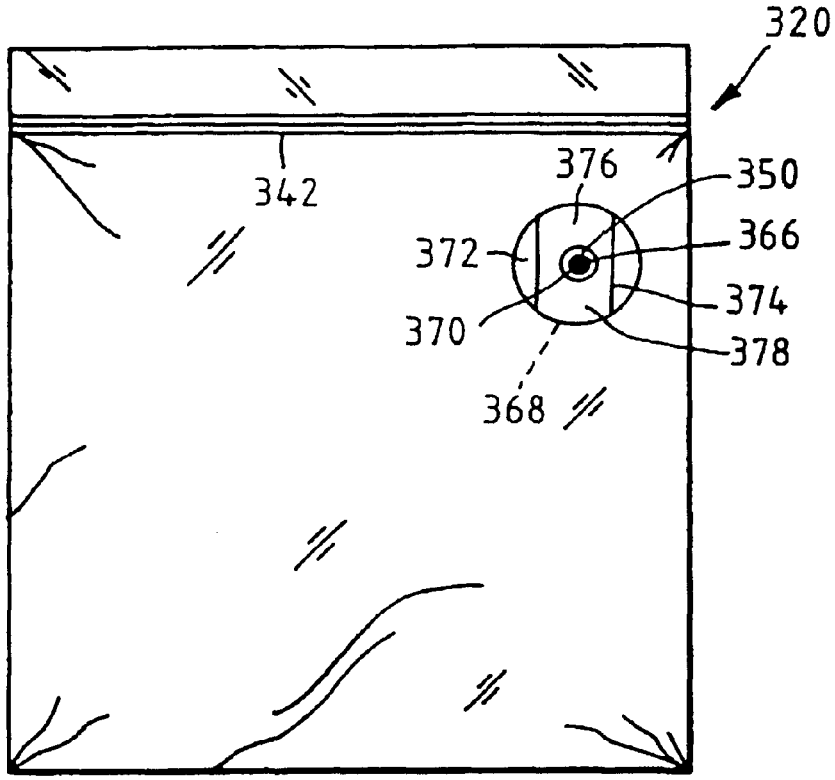
FIG. 8 is front view of third alternative embodiment of a bag constructed in accordance with the teachings of the disclosure.
Figure 9:
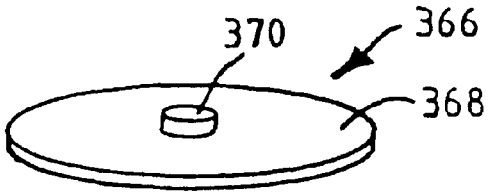
FIG. 9 is a perspective view of the secondary closure element of FIG. 8.

A still further embodiment is depicted in FIGS. 8 and 9. As shown therein, the bag 320 includes an aperture 350 to which a push button 366 is mounted. More specifically, the push button 366 includes a base 368 from which a user-deformable appendage 370 extends. The base 368 may be attached to the bag 320 along first and second sides 372, 374 as by heat sealing, adhesive, ultrasonic welding, or the like. The base 368 is attached such that the appendage 370 extends through the aperture 350 and may be manufactured from any flexible material such as, but not limited to, those materials listed above with regard to the layer 54.

Using such structure, when a user wishes to evacuate gas from within the bag 320 while leaving the primary closure members 342*a*, 342*b* closed, the appendage 370 can simply be depressed. Such motion causes the base 368 to deflect or hinge about the first and second sides 372, 274, thereby causes an air flow passageway to be formed between the bag 320 and the base 368 at Gird and fourth sides 376, 378. Compression of the bag 320 then causes the gas within the bag 320 to be evacuated, whereupon the appendage 370 can be released. Given the flexibility of the base 368, the base 368 reverts to its original shape, abutting the inner surface of the bag 320, thereby reclosing the secondary closure element 352.

From the foregoing, it will be readily understood by those of ordinary skill in the art that the teachings of this disclosure can be used to construct a recloseable storage bag having a primary closure member for closing the bag, and a secondary closure member for evacuating gas from the bag after primary closing.

What is claimed is:

1. A recloseable storage bag, comprising:

a first side having a bottom edge, left edge, right edge, and top edge;

a second side having a bottom edge, left edge, right edge, and top edge, the bottom edges of the first and second sides being attached, the left edges of the first and second sides being attached, and the right edges of the first and second sides being attached;

primary closure members provided proximate the top edges of the first and second sides;

an aperture in at least one of the first and second sides; and a secondary closure element operatively associated with the aperture, the secondary closure element being user-deformable, wherein the secondary closure element includes a rotatable dial mounted proximate the aperture, and wherein the dial includes at least one opening adapted to the rotated into alignment with the aperture.

2. The storage bag of claim 1, wherein the secondary closure elements are made of one of polyethylene, ethyl acetate, and polybutylene.

3. A method of evacuating air from a recloseable storage bag, comprising:

providing a bag having first and second sides connected along first and second side edges thereof, the bag further including a top and bottom, the bottom being closed, the top being adapted to open and close using primary closure members provided proximate the top edges of the first and second sides, the bag further including an aperture in at least one of the first and second sides, and a secondary closure element operatively associated with the aperture, the secondary closure element being user-deformable;

closing the bag using the primary closure members positioned at the top of the sides;

deforming the secondary closure element into an open position by rotating the secondary closure element relative to the aperture, the secondary closure element being a wheel including a opening, the secondary element being deformed when the wheel opening is rotated into alignment with the bag aperture;

compressing the bag and thereby forcing air out of the bag through the secondary closure element; and placing the secondary closure element back into a closed position by rotating the wheel opening out of alignment with the bag aperture.

4. A recloseable storage bag, comprising:

a first side having a bottom edge, left edge, right edge, and top edge;

a second side having a bottom edge, left edge, right edge, top edge, and the bottom edges of the first and second sides being attached, the left edges of the first and second sides being attached, and the right edges of the first and second sides being attached;

primary closure members provided proximate the top edges of the first and second sides; and means for evacuating gas from the bag after the primary closure members are sealed, the means for evacuating being user-deformable, wherein the means for evacuating is a rotatable wheel having an opening adapted to be aligned with an aperture in the bag.

* * * * *